US008197266B2

(12) United States Patent
Neumetzler

(10) Patent No.: US 8,197,266 B2
(45) Date of Patent: Jun. 12, 2012

(54) SURGE PROTECTION PLUG AND GROUND BUS

(75) Inventor: Heiko Neumetzler, Berlin (DE)

(73) Assignee: ADC GmbH, Berlin (DE)

( * ) Notice: Subject to any disclaimer, the term of this patent is extended or adjusted under 35 U.S.C. 154(b) by 34 days.

(21) Appl. No.: 12/744,040

(22) PCT Filed: Oct. 13, 2008

(86) PCT No.: PCT/EP2008/008633

§ 371 (c)(1),
(2), (4) Date: May 20, 2010

(87) PCT Pub. No.: WO2009/065470

PCT Pub. Date: May 28, 2009

(65) Prior Publication Data

US 2010/0248508 A1 Sep. 30, 2010

(30) Foreign Application Priority Data

Nov. 20, 2007 (DE) ..... 10 2007 055 259

(51) Int. Cl.
*H01R 25/00* (2006.01)

(52) U.S. Cl. ..... 439/110; 739/76.1

(58) Field of Classification Search ..... 439/76.1, 439/79, 101, 108, 110, 121
See application file for complete search history.

(56) References Cited

U.S. PATENT DOCUMENTS

| | | | |
|---|---|---|---|
| 4,741,711 | A | 5/1988 | Singer, Jr. |
| 2007/0003056 | A1 | 1/2007 | Otto et al. |

FOREIGN PATENT DOCUMENTS

| | | |
|---|---|---|
| AU | 2001283826 | 12/2001 |
| DE | 43 40 332 | 3/1995 |
| DE | 44 33 936 | 3/1996 |
| DE | 100 29 650 | 1/2002 |
| DE | 102 55 674 | 6/2004 |
| EP | 1 237 229 | 9/2002 |
| WO | WO 97/37407 | 10/1997 |
| WO | WO 2004/036927 | 4/2004 |

*Primary Examiner* — Khiem Nguyen
(74) *Attorney, Agent, or Firm* — Merchant & Gould P.C.

(57) ABSTRACT

The invention relates to a surge protection plug (1) for connector or distributor modules in telecommunications and data fields, comprising a housing and a printed circuit board, wherein at least one surge protection element is disposed on the printed circuit board and the printed circuit board comprises a plug-in region on which electric contact pads are disposed that are electrically connected to the surge protection element, wherein the surge protection element is at least connected to a ground line, wherein the housing (3) is designed in an at least partially electrically conductive manner, wherein the housing (3) is electrically connected at an electrically conductive point to the ground line on the printed circuit board (4) or to a ground connection (23) of the surge protection element (19). The invention further related to a ground bus (2) suitable for this purpose.

11 Claims, 1 Drawing Sheet

SURGE PROTECTION PLUG AND GROUND BUS

RELATED APPLICATIONS

This application is a National Stage Application of PCT/EP2008/008633, filed 13 Oct. 2008, which claims benefit of Serial No. 10 2007 055 259.0, filed 20 Nov. 2007 in Germany and which applications are incorporated herein by reference. To the extent appropriate, a claim of priority is made to each of the above disclosed applications.

TECHNICAL FIELD

The invention relates to an overvoltage protection plug for connection or distribution board modules in telecommunications and data technology and to a grounding rail suitable for this purpose.

BACKGROUND

Such overvoltage protection plugs are known, for example, from DE 100 29 650 A1 and comprise, for example, a housing and a printed circuit board, at least one overvoltage protection element being arranged on the printed circuit board, and the printed circuit board having a plug-in region, on which electrical contact pads are arranged, which are electrically connected to the overvoltage protection element, the overvoltage protection element being connected to at least one ground line. In this case, a metal web is arranged on the printed circuit board, which metal web is electrically connected to the ground line and makes electrical contact with a grounding rail when the overvoltage protection plug is plugged.

SUMMARY

The invention is based on the technical problem of providing an overvoltage protection plug which is simpler in terms of design and of providing a grounding rail suitable for this purpose.

For this purpose, the overvoltage protection plug comprises a housing and a printed circuit board, at least one overvoltage protection element on the printed circuit board having a plug-in region, on which electrical contact pads are arranged, which are electrically connected to the overvoltage protection element, the overvoltage protection element being connected to at least one ground line, the housing being designed to be at least partially electrically conductive, and the housing being electrically connected to the ground line on the printed circuit board or a ground connection of the overvoltage protection element at an electrically conductive point. As a result, the separate contact element on the printed circuit board is no longer required and the housing can be connected to the printed circuit board in a similar manner to an SMD element. If the housing is directly electrically connected to the ground connection of the overvoltage protection element, this connection represents the ground line, so that separate ground lines on the printed circuit board are no longer required.

In a preferred embodiment, the housing is designed to have at least one contact web for making contact with a fork contact of a grounding rail.

Preferably, the contact web is arranged on the inner side of an upper part of the housing.

In a further preferred embodiment, guide elements, in which parts of a grounding rail can be guided, are arranged on the inner sides of side parts of the housing.

In a further preferred embodiment, the housing is completely electrically conductive. This has the advantage of simple manufacture. On the other hand, an embodiment may also be advantageous where part of the housing is electrically nonconductive, so that a user can grip an electrically nonconductive region when handling the plug.

In a further preferred embodiment, the housing is designed to be integral.

In a further preferred embodiment, the housing is made from metal, a metal alloy or a metallized plastic. As the alloy, the housing is preferably formed using zinc diecasting. In embodiments where the housing is only partially electrically conductive, it is preferably manufactured from a two-component plastic, in this case the electrically conductive parts being electroplated.

In a further preferred embodiment, in each case two contact pads are arranged on the upper and the lower side of the printed circuit board in the plug-in region of the printed circuit board. In embodiments only with surge arrestors, in this case the contact pads on the upper side are plated through to the contact pads on the lower side. In embodiments with coordinated protection, the contact pads, on the other hand, are not plated through since the PTC thermistors lie electrically therebetween.

In a further preferred embodiment, the printed circuit board is in the form of a multilayer printed circuit board, the conductor tracks being guided from the overvoltage protection element to the contact pads in a central plane of the multilayer printed circuit board. As a result, the risk of undesired short circuits between the conductor tracks and the housing is reduced.

In a further preferred embodiment, the housing has at least one latching element, via which the overvoltage protection plug can be latched on a housing of a connection or distribution board module.

In a further preferred embodiment, at least two overvoltage protection elements, which are applied to the printed circuit board as a prefabricated unit, are arranged on the printed circuit board. As a result, the overvoltage protection elements have greater mechanical stability, so that unintentional sliding of components against the housing during manufacture and therefore the risk of short circuits is reduced.

In a further preferred embodiment, the housing is soldered to the ground line on the printed circuit board.

In a further preferred embodiment, the housing is adhesively bonded to the ground line on the printed circuit board with electrically conductive adhesive bonds. This type of connection can preferably be used for UESS circuits with low requirements for current-carrying capacity.

BRIEF DESCRIPTION OF THE DRAWINGS

The invention will be explained in more detail below with reference to a preferred exemplary embodiment. In the figures.

DETAILED DESCRIPTION

Figure 1:
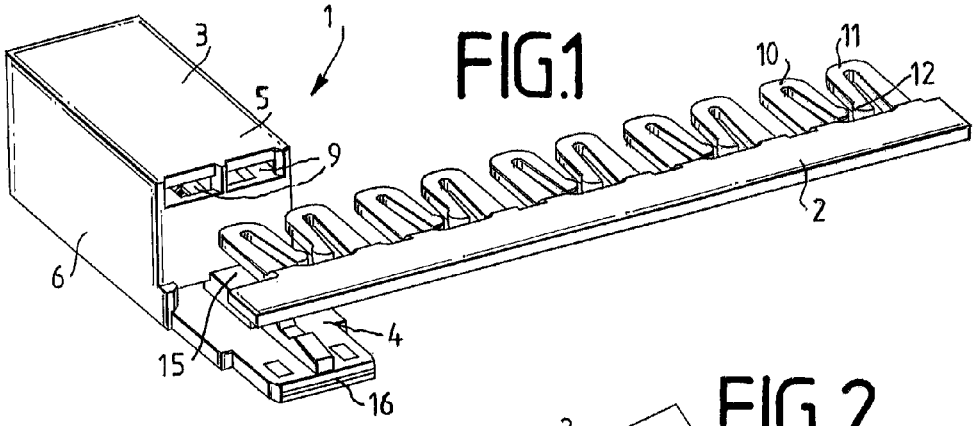
FIG. 1 shows a perspective plan view of an overvoltage protection plug with a grounding rail.
Figure 2:
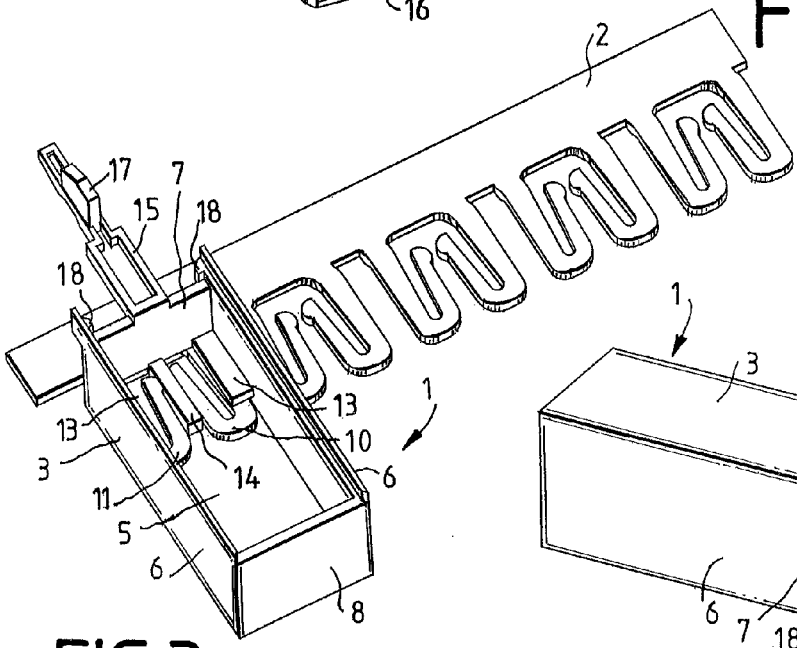
FIG. 2 shows a perspective view from below of FIG. 1 with the printed circuit board removed.
Figure 6:
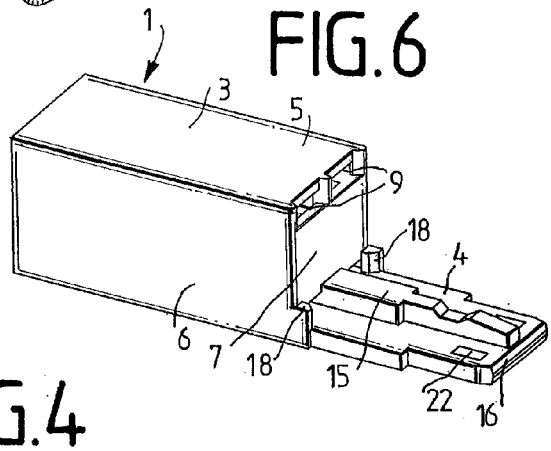
FIG. 6 shows a perspective plan view of the overvoltage protection plug without the grounding rail.
Figure 3:
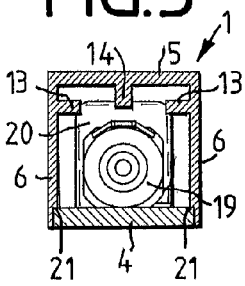
FIG. 3 shows a cross section through the overvoltage protection plug.
Figure 4:
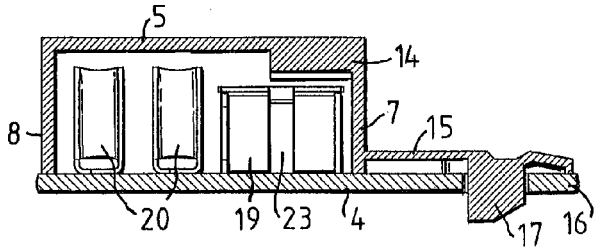
FIG. 4 shows a longitudinal section through the overvoltage protection plug.
Figure 5:
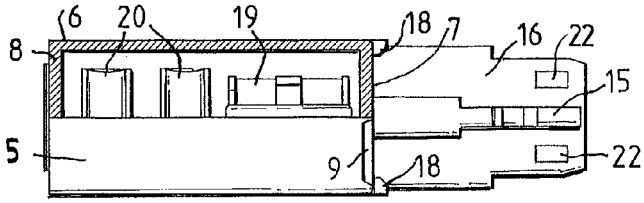
FIG. 5 shows a plan view of the overvoltage protection plug with partially sectioned housing.

FIGS. 1 and 2 illustrate, perspectively, an overvoltage protection plug 1, the latter as yet not having been plugged onto a grounding rail 2. The overvoltage protection plug 1 comprises a housing 3 and a printed circuit board 4. The housing 3 comprises an upper part 5, two side parts 6 and two end sides 7, 8. The lower side is open and is closed by the printed circuit board 4 (see FIG. 3 or 4). The grounding rail 2 comprises a base rail, which is generally designed to be planar. Sprung limbs 10, 11 are arranged at a lower edge of the base rail, the limbs first extending away from the lower edge of the base rail virtually at right angles and then being bent back towards the lower edge again, the bent-back limb parts running towards one another and forming a fork contact 12. For this purpose, the limbs 10, 11 each have a rounded-off contact region pointing towards the other limb. Then fixing means and ground contacts are preferably arranged at the ends of the base rail which are not illustrated, via which fixing means and ground contacts the grounding rail can be fixed on a distribution strip, an electrical connection to a mounting frame being provided via the grounding contact. On the front end side 7, the housing 3 has two slots 9, through which in each case one sprung limb 10, 11 of the grounding rail 2 can enter. In each case one guide element 13, which is located above the slots 9, is arranged on the inner side of the side parts 6. In this case, the guide elements 13 are preferably connected both to the side part 6 and to the front end side 7. A contact web 14, which is arranged on the inner side of the upper part 5 and is preferably also connected to the end side 7, is arranged between the two guide elements 13. Furthermore, a latching element 15, which extends in the direction of a plug-in region 16 of the printed circuit board 4, is arranged on the end side 7. The side parts 6 extend over the end side 7, further latching elements 18 being arranged on the side parts 6. The housing 3 is designed to be completely electrically conductive and is produced, for example, using zinc diecasting. Overvoltage protection elements, namely a surge arrestor 19 and two PTC thermistors 20, are arranged on the printed circuit board 4. The surge arrestor 19 has a ground connection 23, which is connected to at least one ground line on the printed circuit board 4. The ground line is guided to the side parts 6, where it is connected to the housing 3 via two soldered joints 21. Two contact pads 22 are arranged on the printed circuit board 4 in the plug-in region 16. Likewise, two contact pads are arranged on the lower side of the printed circuit board 4. The contact pads 22 are in this case connected to the linear contacts of the overvoltage protection elements 19, 20 via conductor tracks.

If the overvoltage protection plug 1 is now plugged into a connection or distribution board module with the grounding rail 2, the two limbs 10, 11 pass through the slots 9, contact being made with the contact web 14 by means of the fork contact 12. A ground connection via the housing 3 is thus produced. The overvoltage protection plug 1 is mechanically latched on the housing of the connection or distribution board module via the latching tab 17 or the latching element 18.

LIST OF REFERENCE SYMBOLS

1 Overvoltage protection plug
2 Grounding rail
3 Housing
4 Printed circuit board
5 Upper part
6 Side parts
7, 8 End sides
9 Slots
10, 11 Limbs
12 Fork contact
13 Guide element
14 Contact web
15 Latching element
16 Plug-in region
17 Latching tab
18 Latching element
19 Surge arrestor
20 PTC thermistors
21 Soldered joint
22 Contact pads
23 Ground connection

The invention claimed is:

1. An overvoltage protection plug for connection or distribution board modules in telecommunications and data technology, comprising:

an integral housing and a printed circuit board, at least one overvoltage protection element being arranged on the printed circuit board, and the printed circuit board having a plug-in region, on which electrical contact pads are arranged, which are electrically connected to the overvoltage protection element, the overvoltage protection element being connected at least to a ground line, wherein the housing is designed to be electrically conductive, the housing being electrically connected to the ground line on the printed circuit board or a ground connection of the overvoltage protection element at an electrically conductive point;

wherein the housing is formed with a contact web for making contact with a fork contact of a grounding rail; and wherein the housing is made from metal, a metal alloy or a metallized plastic.

2. The overvoltage protection plug as claimed in claim 1, wherein the contact web is arranged on an inside of an upper part of the housing.

3. The overvoltage protection plug as claimed in claim 1, wherein guide elements, in which parts of a grounding rail can be guided, are arranged on inner sides of side parts of the housing.

4. The overvoltage protection plug as claimed in claim 1, wherein in each case two contact pads are arranged on upper and the lower side of the printed circuit board in the plug-in region of the printed circuit board.

5. The overvoltage protection plug as claimed in claim 1, wherein the printed circuit board is in the form of a multilayer printed circuit board, wherein conductor tracks are laid from the overvoltage protection element to the contact pads in a central plane of the multilayer printed circuit board.

6. The overvoltage protection plug as claimed in claim 1, wherein the housing has at least one latching element, via which the overvoltage protection plug can be latched on a housing of a connection or distribution board module.

7. The overvoltage protection plug as claimed in claim 1, wherein at least two overvoltage protection elements, which are applied to the printed circuit board as a prefabricated unit, are arranged on the printed circuit board.

8. The overvoltage protection plug as claimed in claim 1, wherein the housing is soldered to the ground line.

9. An overvoltage protection plug for connection or distribution board modules in telecommunications and data technology, comprising:

a housing that is at least partially electrically conductive, the housing forming a ground contact web configured to engage a fork contact;

a printed circuit board having a first part coupled to the housing and a second part extending outwardly from the housing, the first part of the printed circuit board being spaced from the ground contact web, the printed circuit board having a plug-in region on which electrical contact pads are arranged; and at least one overvoltage protection element being arranged on the printed circuit board and electrically connected to the contact pads of the printed circuit board, the overvoltage protection element being connected at least to the ground contact web.

10. The overvoltage protection plug as claimed in claim 9, wherein the housing is completely electrically conductive.

11. The overvoltage protection plug as claimed in claim 9, wherein the housing is integral.

* * * * *